US008752715B1

(12) United States Patent
Dimock

(10) Patent No.: US 8,752,715 B1
(45) Date of Patent: Jun. 17, 2014

(54) SINK STORAGE TRAY SYSTEM

(71) Applicant: Valerie Dimock, Mesa, AZ (US)

(72) Inventor: Valerie Dimock, Mesa, AZ (US)

( * ) Notice: Subject to any disclaimer, the term of this patent is extended or adjusted under 35 U.S.C. 154(b) by 0 days.

(21) Appl. No.: 13/752,413

(22) Filed: Jan. 29, 2013

Related U.S. Application Data

(60) Provisional application No. 61/633,283, filed on Feb. 8, 2012.

(51) Int. Cl.
*A47L 19/04* (2006.01)

(52) U.S. Cl.
USPC ..... 211/41.1; 206/562

(58) Field of Classification Search
CPC ..... A47J 47/16; A47F 5/01; A47B 81/04; A47B 45/00; A47L 19/04
USPC ..... 211/41.1, 41.3, 41.4, 41.5; 206/562
See application file for complete search history.

(56) References Cited

U.S. PATENT DOCUMENTS

| | | | | | |
|---|---|---|---|---|---|
| 415,634 | A | * | 11/1889 | Guptill | 211/41.4 |
| 2,022,591 | A | * | 11/1935 | Everitt | 312/229 |
| 2,672,988 | A | * | 3/1954 | Johnson | 211/88.01 |
| 2,818,980 | A | * | 1/1958 | Losching | 211/133.5 |
| 3,391,891 | A | * | 7/1968 | Garden | 248/311.2 |
| 3,915,097 | A | * | 10/1975 | Young, Jr. | 108/6 |
| 4,106,736 | A | * | 8/1978 | Becker et al. | 248/222.51 |
| 4,756,582 | A | * | 7/1988 | Heien | 312/229 |
| 4,869,378 | A | * | 9/1989 | Miller | 211/94.01 |
| 5,014,860 | A | * | 5/1991 | Emery | 211/106 |
| 5,163,567 | A | * | 11/1992 | Betts, Sr. | 211/75 |
| 5,180,067 | A | * | 1/1993 | Conaway et al. | 211/119 |
| 5,255,401 | A | * | 10/1993 | Sambrookes et al. | 4/605 |
| 5,588,543 | A | * | 12/1996 | Finger | 211/90.01 |
| 5,620,105 | A | * | 4/1997 | Macek | 211/119 |
| D428,745 | S | * | 8/2000 | Patel et al. | D6/525 |
| D458,492 | S | * | 6/2002 | Ho | D6/525 |
| 6,398,045 | B1 | * | 6/2002 | Chao | 211/181.1 |
| 6,488,246 | B2 | * | 12/2002 | Song | 248/175 |
| 6,530,502 | B2 | | 3/2003 | Neal | |
| 6,729,479 | B2 | * | 5/2004 | Morgan | 211/41.11 |
| 7,104,409 | B2 | * | 9/2006 | Morgan | 211/41.1 |
| D588,415 | S | * | 3/2009 | Ward et al. | D7/601 |
| 7,578,399 | B1 | | 8/2009 | Mulaw | |
| 7,766,175 | B2 | * | 8/2010 | Jadhav et al. | 211/41.9 |
| D628,856 | S | * | 12/2010 | Wang et al. | D7/601 |
| 7,886,917 | B1 | * | 2/2011 | Berger | 211/85.31 |
| 8,186,521 | B2 | * | 5/2012 | Yu | 211/106 |
| 2006/0289372 | A1 | | 12/2006 | Yang | |
| 2008/0135505 | A1 | * | 6/2008 | Frankel et al. | 211/41.4 |
| 2008/0164384 | A1 | * | 7/2008 | Rosen | 248/117.1 |
| 2011/0163054 | A1 | * | 7/2011 | Yu | 211/94.02 |
| 2013/0156531 | A1 | * | 6/2013 | Hashimoto et al. | 414/267 |

* cited by examiner

*Primary Examiner* — Steven A. Reynolds
*Assistant Examiner* — King M Chu
(74) *Attorney, Agent, or Firm* — Emery L. Tracy; Ruth Eure

(57) ABSTRACT

A sink storage tray system for organizing and storage of kitchen accessories and other items is provided. The sink storage tray system comprises a storage tray having a base section and a top section with at least a portion of the top section being parallel to the base section. A plurality of upturned, angled storage bas extend from a first end of the storage tray. A pair of angled storage bars extends from a second end of the storage tray with a distal end of the angled storage bars contacting each other. A substantially circular shaped opening is fanned in the top section of the storage tray, the opening, sized and shaped for holding a bottle in an inverted position.

10 Claims, 1 Drawing Sheet

SINK STORAGE TRAY SYSTEM

The present application claims the benefit of priority of provisional patent application Ser. No. 61/633,283, filed Feb. 8, 2012, entitled "Kitchen Storage Tray".

BACKGROUND OF THE INVENTION

1. Field of the Invention

This invention relates generally to a sink storage tray system and, more particularly, the invention relates to a sink storage tray system providing a specially designed elevated tray configured expressly to provide neat and organized storage for kitchen accessories such as sponges, steel wool pads and dish soap, as well and personal goods.

2. Description of the Prior Art

Perhaps the busiest and most vital room in any home is the kitchen. The kitchen is a popular gathering place for family members and friends and most of the family meals are prepared and eaten in this one room. Additionally, many people use their kitchens as an office of sorts. Providing ample workspace for children to do their homework and where adults can write out bills or balance the checkbook, the kitchen is also an area where many sit and talk on the phone or gossip with family members over the day's activities. Because the kitchen is such a vital component of any home, most people take steps to make sure this room is carefully decorated, neat and clean. In particular, the area around the kitchen sink can be easily cluttered with steel wool pads, scrub brushes, dish soap and other accessories utilized to wash dishes. In addition, when doing the dishes, most people find it necessary to remove jewelry such as rings and bracelets in order to avoid accidentally dropping these precious items down the drain. Unfortunately, making room on a kitchen countertop for all of these items can be a daunting challenge. Creating messy clutter, supplies such as sponges, scrub brushes and other goods can look unsightly if left out in the open, while items such as steel wool pads can rust and cause hard to remove stains. Further, if jewelry is left on a countertop it can be easily knocked onto the floor or otherwise misplaced.

SUMMARY

The present invention is a sink storage tray system for organizing and storage of kitchen accessories arid other items, The sink storage tray system comprises a storage tray having a base section and a top section with at least a portion of the top section being parallel to the base section. A plurality of upturned, angled storage bars extend from a first end of the storage tray. A pair of angled storage bars extends from a second end of the storage tray with a distal end of the angled storage bars contacting each other. A substantially circular shaped opening is formed in the top section of the storage tray, the opening sized and shaped for holding a Untie in an inverted position.

In addition, the present invention includes a sink storage tray system for organizing and storage of kitchen accessories and other items. The sink storage tray system comprises a storage tray having a base section and a top section with at least a portion of the top section being parallel to the base section. The base section has a plurality of parallel bars and the top section has a plurality of corresponding U-shaped bars positioned on the base section. The parallel bars are aligned with the U-shaped bars. A plurality of upturned, storage bars extend from a first end of the storage tray. A pair of angled bars extends from a second end of the storage tray with a distal end of the angled bars contacting each other. A substantially circular shaped opening is formed in the top section of the storage tray with the opening sized and shaped for holding a bottle in an invested position.

The present invention further includes a method for organizing and storage of kitchen accessories and other items. The method comprises providing a storage tray having a base section and a top section with at least a portion of the top section being parallel to the base section and the base section having a plurality of parallel bars and the top section having a plurality of corresponding U-shaped bars positioned on the base section, aligning the parallel bars with the U-shaped bars, extending a plurality of upturned, storage bars from a first end of the storage tray, extending a pair of angled bars from a second end of the storage tray with a distal end of the angled bars contacting each other, forming a substantially circular shaped opening in the top section of the storage tray, and positioning an inverted bottle within the opening.

DETAILED DESCRIPTION OF THE PREFERRED EMBODIMENTS

Figure 3:
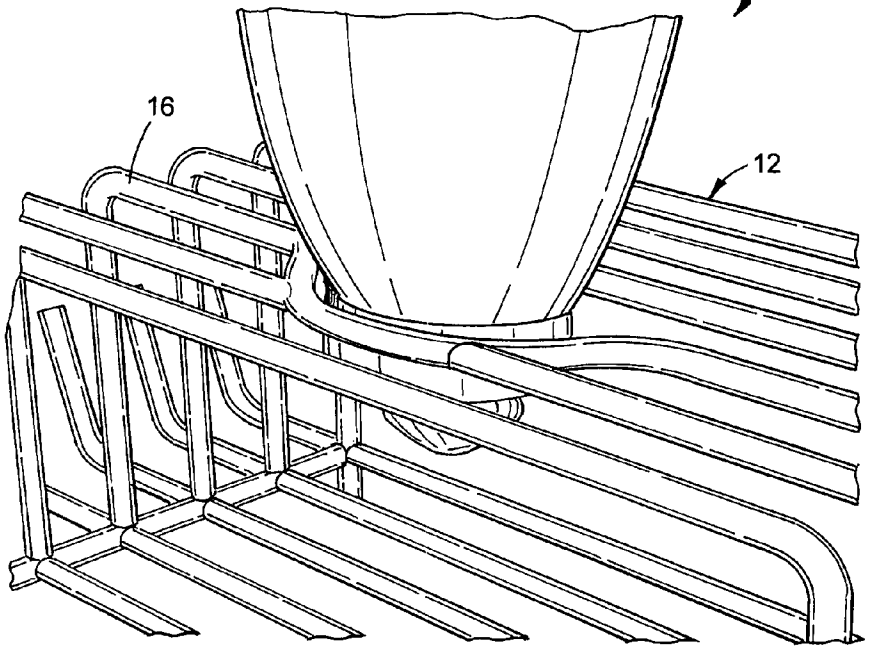
FIG. 3 is another perspective view illustrating the sink storage system, constructed in accordance with the present invention, with dish soap bottle resting upside down to use remaining liquid.
Figure 1:
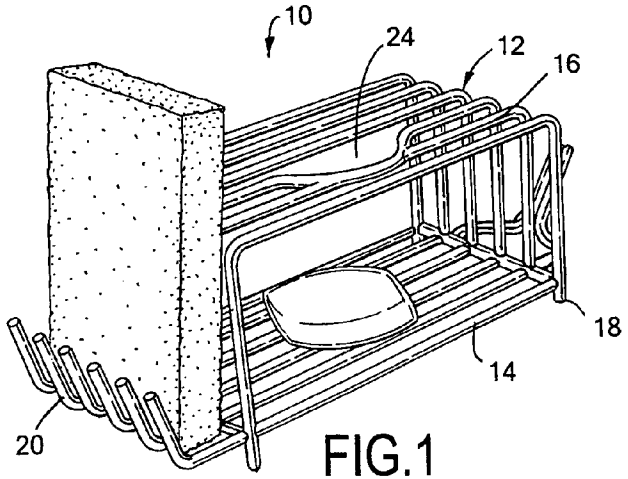
FIG. 1 is a front perspective view illustrating a sink storage tray system, constructed in accordance with the present invention, with a sponge holder.
Figure 2:
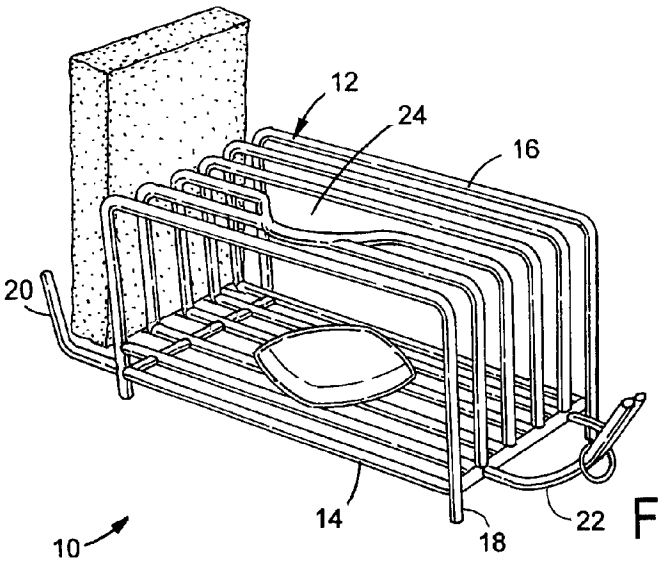
FIG. 2 is a rear perspective view illustrating die sink storage system, constructed in accordance with the present invention, with a ring holder.

As illustrated in FIGS. 1-3, the present invention is a sink storage tray system, indicated generally at 10, providing a specially designed elevated tray configured expressly to provide neat and organized storage for kitchen accessories such as sponges, steel wool pads and dish soap, as well and personal goods. The sink storage tray system 10 of the present invention can be constructed of heavy duty plastic or reinforced coated wire material although using other materials to construct the sink storage tray system is within the scope of the present invention. Generally square in shape, the sink storage tray system 10 measures approximately live (5") inches in length, by approximately three (3") inches to five (5") inches in width, and approximately three (3") inches in total depth although constructing the sink storage tray system with greater or lesser dimensions is within the scope of the present invention.

The sink storage tray system 10 of the present invention includes a storage tray 12 having a first end, a second end, a base section 14, and a top section 16. The base section 14 of the storage tray 12 is preferably constructed of a plurality of parallel bars and the top section 16 of the storage tray 12 is preferably constructed of a plurality of corresponding U-shaped bars positioned on the base section 14. The U-shaped bars of the top section 16 extend from the parallel bars of the base section 14 with at least a portion of the top section 16 parallel to the base section 14. The top section 16 and the base section 14 provide ample storage while the spaced U-shaped bars of the top section 16 and the spaced parallel bars of the base section 14 afford ample drainage of liquid from the base section 14.

Positioned in each corner of the base section 14 of the sink storage tray system 10 of the present invention is a sturdy leg 18 to slightly elevate the base section 14 of the storage tray 12 to assist in the draining process. The legs 18 preferably extend substantially perpendicular to the base section 14.

Extending from the first end of the storage tray 12 of the sink storage tray system 10 of the present invention, preferably aligned with each parallel bar of the base section 16, are a plurality of upturned, angled storage bars 20. The storage bars 20 are sized and shaped for accommodating a variety of items including, but not limited to, a sponge and the like. Extending from the second end of the storage tray 12, two bars 22 angle in a general direction toward each other until they contact thereby creating a jewelry holder. The user can easily and safely position rings and/or bracelets directly on the jewelry holder for safekeeping.

Positioned in an approximate center of the top section 16 of the storage tray 12 of the sink storage tray system 10 of the present invention is a substantially circular shaped opening 24, configured expressly for storing a bottle of dish soap in the inverted position. The opening 24 allows the user position at least a portion of an upside down dish soap bottle within the opening 24 thereby to utilizing the entire contents of the bottle. The storage tray 12 can be produced in a variety of vibrant colors to correspond with various kitchen decors, as well as a myriad of neutral hues.

The manner of use of the sink storage tray system 10 of the present invention will now be described. It will be understood by those skilled in the art that the manner of use of the sink storage tray system 10 described herein is merely one method of use and other methods of use of the sink storage tray system 10 are within the scope of the present invention.

Use of the sink storage tray system 10 of the present invention is very simple and straight forward. First, the user purchases the sink storage tray system 10 in the desired color or material. For instance, a sleek wire version of the sink storage tray system 10 looks striking in a kitchen boasting a modern design theme. Alternately, one may purchase a plastic unit in a pale blue hue to correspond with a kitchen featuring a casual country theme. Once purchased, the user places the sink storage tray system 10 on or beside their kitchen sink. The user then loads the storage sink tray system 10 with the desired kitchen accessories. For instance, the user might place an inverted bottle of dish soap in she circular shaped opening in the top section positioned in the approximate center of the top section, vertically securing the bottle while also allowing all of the contents of the soap to flow to the pour spout. The user can then place a sponge on one of the upturned bars 20, while a scouring brush and steel wool pad can be placed inside the tray. Prior to washing a load of dishes, the user can remove any rings and jewelry, inserting these items over the upturned bars 22 to provide secure and reliable storage. As needed, items can be removed from the tray and replaced following use.

The sink storage tray system 10 of the present invention offers users a number of significant benefits and advantages. Foremost, the sink storage tray system 10 provides users neat and orderly storage for the kitchen sink area, inside of which various cleanings supplies and other small goods can be conveniently stored and easily accessed. Eliminating the need to store scouring brushes, steel wool pads and sponges directly on the sink ledge, use of the sink storage tray system 10 provides a neat and functional kitchen area. Sparing the householder unsightly clutter in the kitchen, the sink storage tray system 10 also affords a safe and reliable means of storing jewelry such as rings and bracelets when doing the dishes. As such, users can avoid the frustrating scenario of losing expensive jewelry items down the sink drain, as well as the expense of hiring a plumber to retrieve these goods. Another important advantage to the sink storage tray system 10 is that because the storage tray 12 enables the user to store a bottle of dish soap upside down, the entire contents of the bottle can be easily used, preventing unnecessary waste and saving money. Offered in both sleek wire and colorful plastic versions, the sink storage tray system 10 lends a striking decorative touch to any kitchen decor.

The sink storage tray system 10 of the present invention provides efficient storage for various kitchen supplies. Providing easy and organized access to various kitchen accessories, as well as personal items such as jewelry, the sink storage tray system 10 proves a favorite accessory in any kitchen.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A sink storage tray system for organizing and storage of kitchen accessories and other items, the sink storage tray system comprising:

a storage tray having a base section and a top section, at least a portion of the top section being parallel to the base section, the base section having a plurality of parallel bars and the top section having a plurality of corresponding U-shaped bars positioned on the base section, the parallel bars aligned with the U-shaped bars, the parallel bars of the base section having a first end and a second end;

a first perpendicular bar mounted to the first end of the base section;

a second perpendicular bar mounted to the second end of the base section, the first perpendicular bar and the second perpendicular bar being perpendicular to the parallel bars of the base section; and a substantially circular shaped opening formed in the top section of the storage tray, the opening sized and shaped for holding a bottle in an inverted position;

wherein the top section is free from perpendicular bars between the first perpendicular bar and the second perpendicular bar, the top section capable of receiving and holding shallow dishes.

2. The sink storage tray system of claim 1 wherein the storage tray is constructed of heavy duty plastic or reinforced coated wire material.

3. The sink storage tray system of claim 1 wherein the base section has a plurality of parallel bars and the top section has a plurality of corresponding U-shaped bars positioned on the base section.

4. The sink storage tray system of claim 3 wherein the U-shaped bars of the top section extend from the parallel bars of the base section with at least a portion of the top section parallel to the base section.

5. The sink storage tray system of claim 1 and further comprising:

a leg positioned in each corner of the base section, the legs elevating the base section.

6. The sink storage tray system of claim 5 wherein the legs extend substantially perpendicular to the base section.

7. The sink storage tray system of claim 1 and further comprising:

a plurality of upturned, angled storage bars extending from a first end of the storage tray.

8. The sink storage tray system of claim 1 and further comprising:

a pair of angled storage bars extending from a second end of the storage tray, a distal end of the angled storage bars contacting each other.

9. The sink storage tray system of claim 7 wherein the storage bars are sized and shaped for accommodating a sponge.

10. The sink storage tray system of claim 8 wherein the angled bars are sized and shaped for accommodating a ring or bracelet.

* * * * *